US009631309B2

(12) United States Patent
Kongo

(10) Patent No.: US 9,631,309 B2
(45) Date of Patent: Apr. 25, 2017

(54) EMBROIDERY SEWING MACHINE HAVING FUNCTION OF FIXING INTERLINER AND MATERIAL BY BASTING

(71) Applicant: Janome Sewing Machine Co., Ltd., Tokyo (JP)

(72) Inventor: Takeshi Kongo, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 15/168,339

(22) Filed: May 31, 2016

(65) Prior Publication Data

US 2017/0016159 A1 Jan. 19, 2017

(30) Foreign Application Priority Data

Jul. 13, 2015 (JP) ..... 2015-139416

(51) Int. Cl.
*D05B 21/00* (2006.01)
*D05C 5/06* (2006.01)
*D05B 19/04* (2006.01)

(52) U.S. Cl.
CPC ..... *D05C 5/06* (2013.01); *D05B 19/04* (2013.01)

(58) Field of Classification Search
CPC ... D05C 5/00; D05C 5/02; D05C 5/04; D05C 5/06; D05B 19/02; D05B 19/04; D05B 19/06; D05B 19/08; D05B 19/10; D05B 19/12
USPC ..... 700/136–138
See application file for complete search history.

(56) References Cited

U.S. PATENT DOCUMENTS 5,438,520 A * 8/1995 Satoh ..... D05B 19/08 112/102.5
2008/0264319 A1* 10/2008 Hayakawa ..... D05B 19/04 112/470.04

FOREIGN PATENT DOCUMENTS

JP 2008-264503 A 11/2008

* cited by examiner

*Primary Examiner* — Nathan Durham
(74) *Attorney, Agent, or Firm* — Nakanishi IP Associates, LLC

(57) ABSTRACT

An embroidery sewing machine having a function of fixing an interliner and a material by basting, and capable of performing embroidery sewing based on embroidery sewing data includes: a basting area accepting unit configured to perform an assisting operation for a user so as to allow the user to specify an area for basting according to a size of a material, and to accept the specification of the area for basting; a basting data generating unit configured to generate basting data according to the area accepted by the basting area accepting unit; and a basting executing unit configured to perform basting based on the basting data generated by the basting data generating unit.

7 Claims, 10 Drawing Sheets

EMBROIDERY SEWING MACHINE HAVING FUNCTION OF FIXING INTERLINER AND MATERIAL BY BASTING

CROSS REFERENCE TO RELATED APPLICATIONS

This application is based on and claims the benefit of priority to Japanese Patent Application No. 2015-139416 filed on Jul. 13, 2015, the contents of which are hereby incorporated by reference in their entirety.

TECHNICAL FIELD

The present invention relates to an embroidery sewing machine having a function of fixing an interliner and a material by basting.

BACKGROUND ART

When embroidery is performed using a sewing machine, if a material (object to be sewn) is normal cloth or the like, the cloth is held and fixed by an embroidery frame. However, if the material is hard and lacking flexibility as in a case of leather or plastic, such a material may not be held by an embroidery frame as the frame can damage the material. Further, the material may not be held and fixed by an embroidery frame if the material is smaller than an embroidery frame.

In these cases, generally, an interliner is first held by an embroidery frame, and a leather or plastic material is fixed over the interliner. While examples of the fixing of cloth include thermal adhesion to an interliner, it is not possible to heat a material if leather or plastic is used, as leather or plastic is damaged by heat. When a leather or plastic material is used, the material may be fixed to an interliner by basting at covert portions around the material.

Here, if the material is common cloth, this object may be realized by basting along a rectangular line or an outline close to an embroidery pattern. However, when a leather or plastic material is used, basting in the center of the material leaves pinholes in the material, which pinholes spoil an embroidery work. Therefore, in a process of making an embroidery work, it is necessary to fix a material to an interliner covertly by basting at portions that are stitched inside or that are cut.

Preparing a sewing machine for normal sewing only for basting to perform basting by manual feeding would considerably impair workability. Thus, it is desirable to perform basting by appropriately generating basting data and by using an embroidery function of a sewing machine.

Patent Literature 1 discloses a sewing machine that generates baste sewing data with a predetermined interval around an outline of an embroidery pattern.

PRIOR ART LITERATURE

Patent Literature

[Patent Literature 1] Japanese Unexamined Patent Application Publication No. 2008-264503

However, as the sewing machine of Patent Literature 1 generates baste sewing data based on an embroidery pattern in order to prevent shrinkage (for reinforcement), it is difficult to perform basting at portions that are stitched inside or that are cut as described above. Specifically, when basting is performed to a leather or plastic material, it is not possible to perform basting at portions as intended by a user according to a size of the material even when baste sewing data generated based on an embroidery pattern is used as disclosed in Patent Literature 1.

SUMMARY OF THE INVENTION

One or more embodiments according to the present invention provide an embroidery sewing machine having a function of fixing an interliner and a material by basting, the function allowing simple and appropriate basting according to a size of the material even when the material cannot be fixed only with an embroidery frame.

Embodiment 1

One or more embodiments according to the present invention is an embroidery sewing machine having a function of fixing an interliner and a material by basting, and capable of performing embroidery sewing based on embroidery sewing data, the embroidery sewing machine including: a basting area accepting unit configured to perform an assisting operation for a user so as to allow the user to specify an area for basting according to a size of a material, and to accept the specification of the area for basting; a basting data generating unit configured to generate basting data according to the area accepted by the basting area accepting unit; and a basting executing unit configured to perform basting based on the basting data generated by the basting data generating unit.

Embodiment 2

One or more embodiments according to the present invention is the embroidery sewing machine according to the embodiment 1 having a function of fixing an interliner and a material by basting, wherein the basting area accepting unit accepts the specification of the basting area while a relative position between an embroidery frame and a needle is actually moved in the assisting operation in response to the user's operation.

Embodiment 3

One or more embodiments according to the present invention is the embroidery sewing machine according to the embodiment 1 having a function of fixing an interliner and a material by basting, wherein the basting area accepting unit accepts a rectangular area of a size contained within an embroidery frame.

Embodiment 4

One or more embodiments according to the present invention is the embroidery sewing machine according to one of the embodiments 1 having a function of fixing an interliner and a material by basting, the embroidery sewing machine including a basting position editing unit configured to perform position change and/or deletion to a site corresponding to any linear stitches separately in the basting data generated by the basting data generating unit.

Embodiment 5

One or more embodiments according to the present invention is the embroidery sewing machine according to one of the embodiments 1 having a function of fixing an interliner and a material by basting, the embroidery sewing machine including: a basting pitch editing unit configured to separately change a pitch of a basting stitch of a side corresponding to any of linear stitches separately in the basting data generated by the basting data generating unit.

Embodiment 6

One or more embodiments according to the present invention is the embroidery sewing machine according to one of the embodiments 1 having a function of fixing an interliner and a material by basting, the embroidery sewing machine further including: a trace start accepting unit configured to accept an instruction to start tracing; and a trace executing unit configured to perform a trace operation in response to the acceptance of the instruction to start tracing by the trace start accepting unit, the trace operation being for moving an inter liner with respect to a needle based on the basting data without sewing.

Embodiment 7

One or more embodiments according to the present invention is the embroidery sewing machine according to one of the embodiments 1 having a function of fixing an interliner and a material by basting, the embroidery sewing machine including: a basting start accepting unit configured to accept an instruction to start basting, wherein the basting executing unit performs basting based on the basting data, separately from embroidery sewing, in response to the acceptance of the instruction to start basting by the basting start accepting unit.

Embodiment 8

One or more embodiments according to the present invention is the embroidery sewing machine according to one of the embodiments 1 having a function of fixing an interliner and a material by basting, the embroidery sewing machine further including: an embroidery start accepting unit configured to accept an instruction to start embroidery sewing; and an embroidery executing unit configured to perform embroidery sewing based on the embroidery sewing data, separately from basting, in response to the acceptance of the instruction to start embroidery by the embroidery start accepting unit.

According to one or more embodiments of the present invention, it is possible to provide an embroidery sewing machine having a function of fixing an interliner and a material by basting, the function allowing simple and appropriate basting according to a size of the material even when the material cannot be fixed only with an embroidery frame.

DETAILED DESCRIPTION

Hereinafter, best modes for carrying out the present invention will be described with reference to the drawings.

EMBODIMENT

Figure 1:
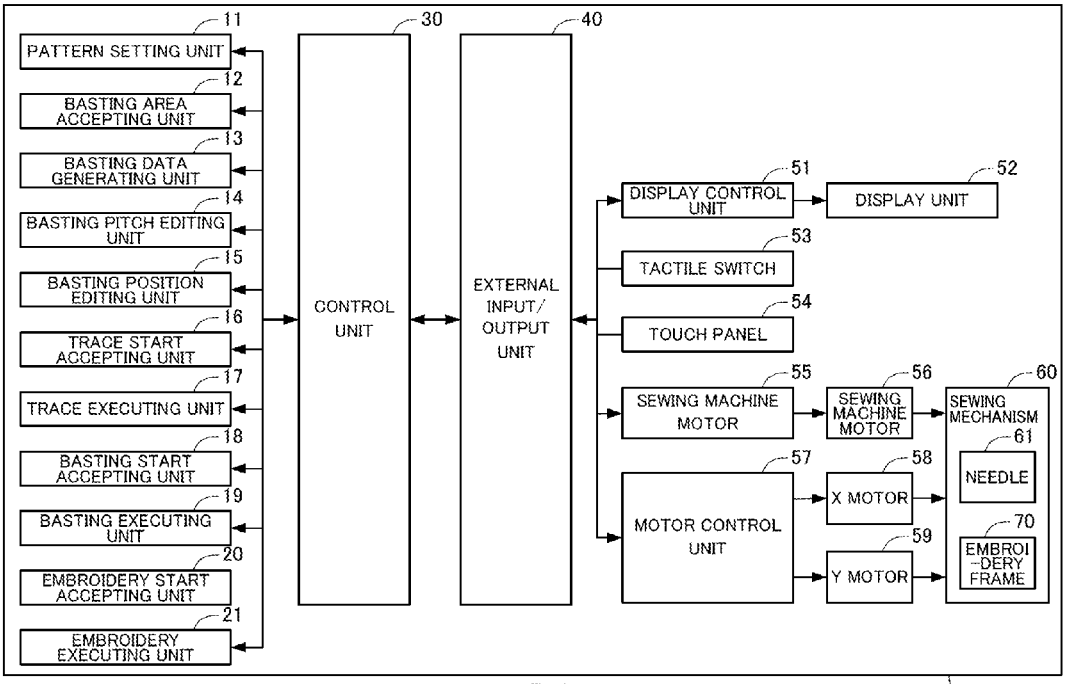
FIG. 1 is a block diagram illustrating a configuration of an embroidery sewing machine 1 according to the present embodiment.

FIG. 1 is a block diagram illustrating a configuration of an embroidery sewing machine 1 according to the present embodiment.

While reference is made to specific values, shapes, materials, and the like in the following description, these specifics may be altered as needed.

The embroidery sewing machine 1 includes a pattern setting unit 11, a basting area accepting unit 12, a basting data generating unit 13, a basting pitch editing unit 14, a basting position editing unit 15, a trace start accepting unit 16, a trace executing unit 17, a basting start accepting unit 18, a basting executing unit 19, an embroidery start accepting unit 20, an embroidery executing unit 21, a control unit 30, an external input/output unit 40, a display control unit 51, an display unit 52, a tactile switch 53, a touch panel 54, a sewing machine motor control unit 55, a sewing machine motor 56, an XY motor control unit 57, an X motor 58, a Y motor 59, a sewing mechanism 60, a needle 61, and an embroidery frame 70.

The pattern setting unit 11 presents, to a user, patterns recorded in a recording unit that is not shown or in an external medium such as a flash memory so that the user is able to select a pattern with which embroidery is performed from the presented patterns, and sets the pattern selected by the user as a pattern used for embroidery.

The basting area accepting unit 12 performs an assisting operation to the user so that the user may specify a basting area according to a size of a material, and accepts the specification of the basting area by the user via the touch panel 54. More specifically, the basting area accepting unit 12 accepts an input operation by the user via the touch panel 54, and, as the assisting operation, drives the sewing mechanism 60 using the XY motor control unit 57, the X motor 58, and the Y motor 59 to move the embroidery frame 70 with respect to the needle 61 based on the input operation. This allows the user to specify an area for basting while actually confirming the basting area, and thus to specify the basting area appropriately according to the size of the material. According to this embodiment, the basting area accepting unit 12 accepts an input of coordinates at two diagonal positions of a rectangular area to which basting is performed. Here, the basting area acceptable by the basting area accepting unit 12 is within a rectangular area that can be contained in the embroidery frame 70.

The basting data generating unit 13 generates basting data according to the area accepted by the basting area accepting unit 12.

The basting pitch editing unit 14 performs an editing operation for changing a pitch for basting stitch separately for any of linear stitches along four sides of the basting data generated by the basting data generating unit 13.

The basting position editing unit 15 performs an editing operation for changing and/or deleting of a position separately for any of linear stitches along four sides in the basting data generated by the basting data generating unit 13.

The trace start accepting unit 16 accepts an instruction to start tracing from the user via the touch panel 54.

The trace executing unit 17 performs a trace operation in response to the acceptance of the instruction to start tracing by the trace start accepting unit 16. In the trace operation, an interliner 100 is moved with respect to the needle 61 based on the basting data without sewing.

The basting start accepting unit 18 accepts an instruction to start basting from the user via the touch panel 54.

The basting executing unit 19 performs basting based on the basting data generated by the basting data generating unit 13.

The basting executing unit 19 performs basting, separately from embroidery sewing, in response to the acceptance of the instruction to start basting by the basting start accepting unit 18, based on the basting data generated by the basting data generating unit 13.

The embroidery start accepting unit 20 accepts an instruction to start embroidery sewing from the user via the touch panel 54.

The embroidery executing unit 21 performs embroidery sewing based on embroidery sewing data, separately from basting, in response to the acceptance of the instruction to start embroidery sewing by the embroidery start accepting unit 20.

The control unit 30 is a central processing unit for integrally controlling an operation of the embroidery sewing machine 1. A function of the control unit 30 may be configured as a dedicated circuit, or may be realized by executing a program recorded in the recording unit that is not shown. Further, functions of the pattern setting unit 11, the basting area accepting unit 12, the basting data generating unit 13, the basting pitch editing unit 14, the basting position editing unit 15, the trace start accepting unit 16, the trace executing unit 17, the basting start accepting unit 13, the basting executing unit 19, the embroidery start accepting unit 20, and the embroidery executing unit 21 described above may also be realized as a part of the function of the control unit 30.

The external input/output unit 40 is an interface with which the control unit. 30 performs data transmission with external devices.

The display control unit 51 controls display of a pattern or characters in the display unit 52, under control of the control unit 30.

The display unit 52 is configured by a liquid crystal display, for example, and controlled by the display control unit 51 to display a pattern or characters.

The tactile switch 53 and the touch panel 54 are disposed at positions operable by the user. When the tactile switch 53 and the touch panel 54 are operated by the user, a signal corresponding to the operation is transmitted to the control unit 30. Here, the touch panel 54 is lapped over the display unit 52, and the display unit 52 and the touch panel 54 integrally constitute a display and operating unit.

The sewing machine motor control unit 55 controls, under control of the control unit 30, to drive the sewing mechanism 60 via the sewing machine motor 56, and controls a needle bar that is not shown.

The sewing machine motor 56 is controlled by the sewing machine motor control unit 55 so as to produce a driving force required for driving the sewing mechanism 60.

The XY motor control unit 57 controls, under control of the control unit 30, to drive the X motor 56 and the Y motor 59, and moves the embroidery frame 70 of the sewing mechanism 60 in X and Y directions. Based on the instruction to the X motor 58 and the Y motor 59, a falling point of the needle is determined and a stitch is formed.

The X motor 58 and the Y motor 59 are controlled by the XY motor control unit 57, and produce a driving force for moving the embroidery frame 70 within a plane perpendicular to a moving direction of the needle bar (XY plane).

The sewing mechanism 60 serves as a driving mechanism of the embroidery frame 70 and a driving mechanism of the needle bar to which the needle 61 is attached, and is driven by a driving force produced by the sewing machine motor 56, the X motor 58, and the Y motor 59 as described above.

Next, a specific example of the operation of the embroidery sewing machine 1, mainly focusing on the basting operation.

Figure 2:
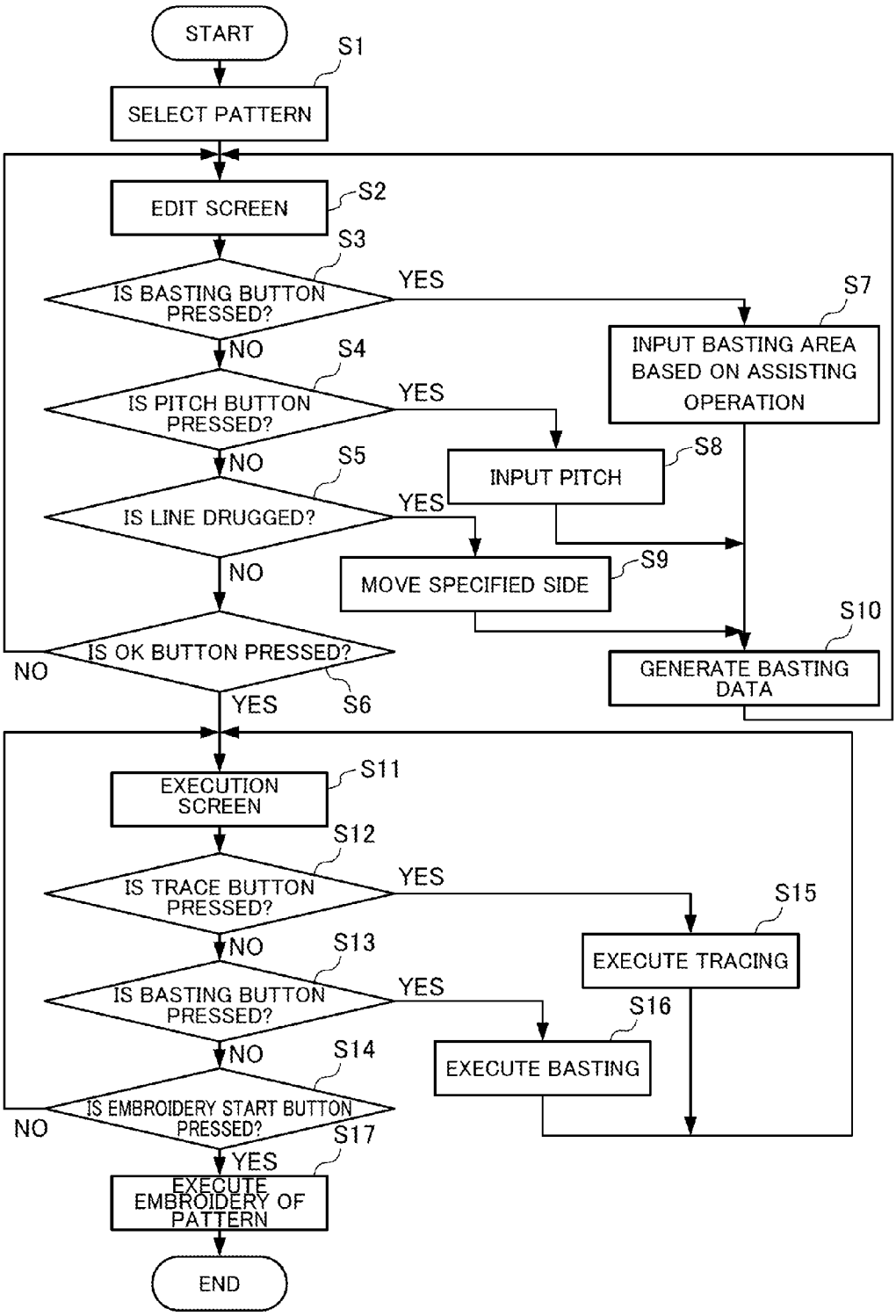
FIG. 2 is a flowchart for describing an operation of the embroidery sewing machine 1.

FIG. 2 is a flowchart for describing the operation of the embroidery sewing machine 1.

In Step (hereinafter simply referred to as S) 1, the pattern setting unit 11 receives selection of the pattern with which embroidery is performed from the user, and the display shifts to an edit screen accordingly (S2).

In S2, the control unit 30 displays the edit screen in the display unit 52.

Figure 3:
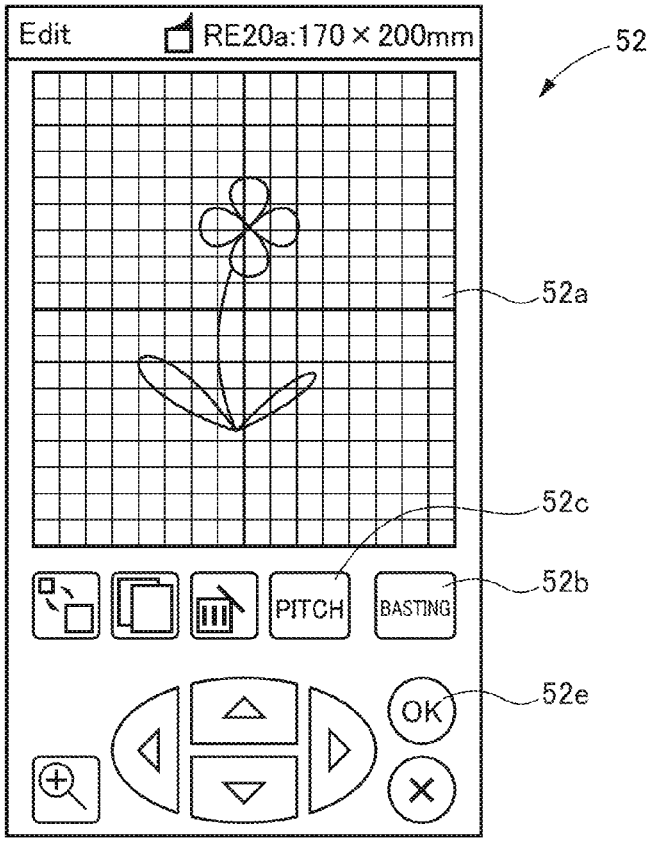
FIG. 3 is a diagram illustrating a display example of a display unit 52 in which an edit screen is shown.

FIG. 3 is a diagram illustrating a display example of the display unit 52 in which the edit screen is shown.

Figure 4:
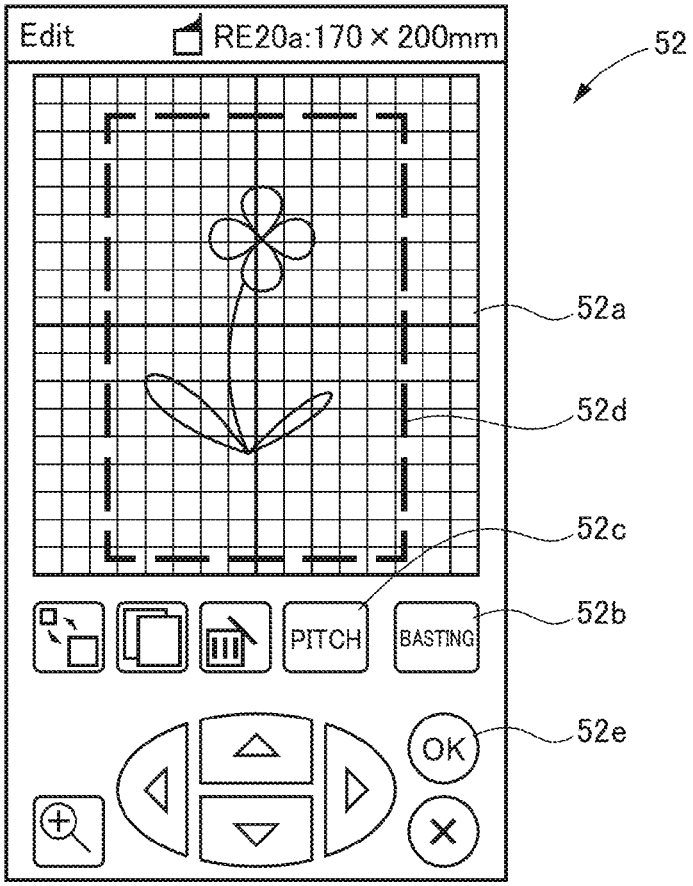
FIG. 4 is a diagram illustrating a display example of the display unit 52 in which a basting area is shown in the edit screen.

FIG. 4 is a diagram illustrating a display example of the display unit 52 in which a basting area is shown in the edit screen.

In the following description, among buttons displayed in the display unit 52, only those related to the present invention will be described.

In the edit screen, generation and editing of the basting data may be performed.

An embroidery pattern selected in S1 is displayed in a pattern display unit 52*a*.

In S3, the control unit 30 determines whether or not a basting button 52*b* is pressed. If the basting button 52*b* is pressed, the operation moves to acceptance of the basting area (S7). On the other hand, if the basting button 52*b* is not pressed, the operation moves to S4.

In S4, the control unit 30 determines whether or not a pitch button 52*c* is pressed. If the pitch button 52*c* is pressed, the operation moves to pitch input (S8). On the other hand, if the pitch button 52*c* is not pressed, the operation moves to S5.

In S5, the control unit 30 determines whether or not a rectangular line 52*d* indicating the basting area displayed in the pattern display unit 52*a* is drugged. If the line 52*d* indicating the basting area is drugged, the operation moves to Step (S9) for moving a corresponding side. On the other hand, if the line 52*d* indicating the basting area is not pressed, the operation moves to S6.

In S6, the control unit. 30 determines whether or not an OK button 52*e* is pressed. If the OK button 52*e* is pressed, the screen ends the edit screen and shifts to an execution screen in S11. On the other hand, if the OK button 52*e* is not pressed, the operation returns to S2, and the above steps are repeated.

In S7, the basting area accepting unit 12 displays a dialog box with which the basting area is accepted in the display unit 52.

Figure 5:
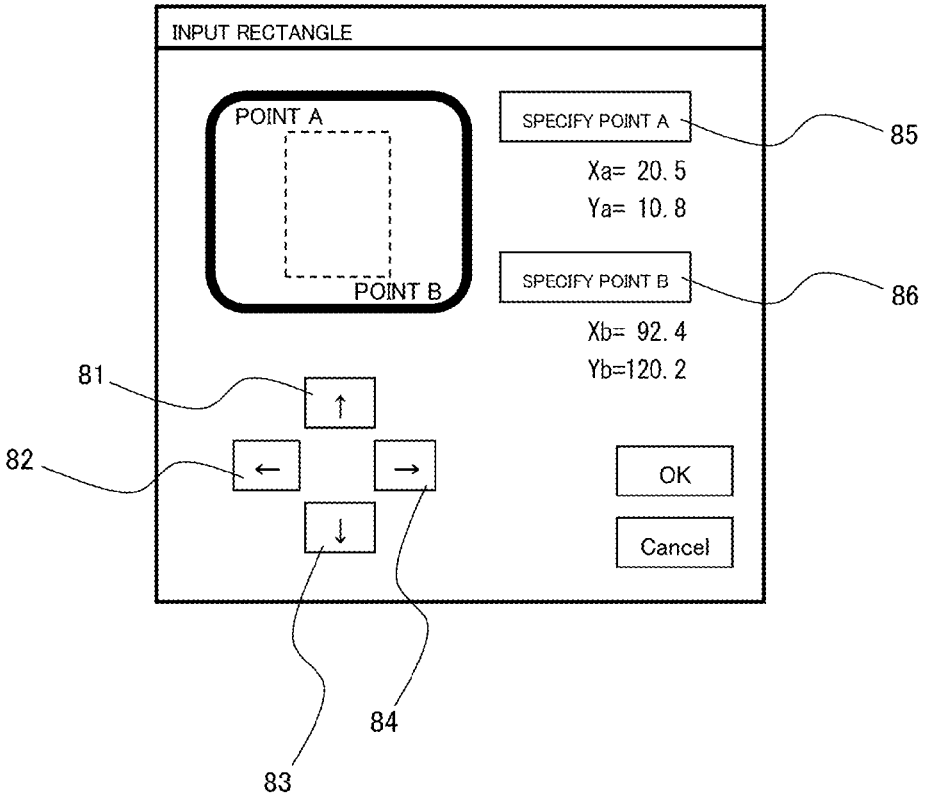
FIG. 5 is a diagram illustrating a display example of a dialog box with which the basting area is accepted.

FIG. 5 is a diagram illustrating a display example of the dialog box with which the basting area is accepted.

In the dialog box with which the basting area is accepted, the user specifies an upper left coordinate (point A) and a lower right coordinate (point B) of a material 110 placed on the interliner 100. When the user continuously presses jog buttons 81, 82, 83, 84 for moving the embroidery frame 70, the embroidery frame 70 moves at a speed about 5 mm/sec to a direction indicated by the pressed button. The user adjusts the position using the jog buttons 81, 82, 83, 84 such that a tip end of the needle 61 comes inwardly by 2 mm to 3 mm from the upper left of the material 110. Pressing a point A specifying button 85 when the needle 61 comes immediately above the upper left of the basting area (point A), a coordinate Xa and Ya at this point is shown. Similarly, when a coordinate for the point. B, which is a lower right of the basting area, is specified using a point B specifying button 86, a coordinate Xb and Yb at this point is shown, and the coordinates defining a rectangle within the material are input. Based on values of the coordinates input in S7, an area of rectangle to which basting is performed is determined, and the line 52*d* indicating a corresponding basting area is displayed in the pattern display unit 52*a*.

Here, in this embodiment, the example in which the basting area is rectangular is described, but the present invention is not limited to such an example, and the basting area may be polygonal. In this case, similarly to the example of the rectangular area, the basting area may be specified by sequentially specifying apexes of a polygon.

In S8, the basting pitch editing unit 14 displays a dialog box for inputting a pitch in the display unit 52.

Figure 6:
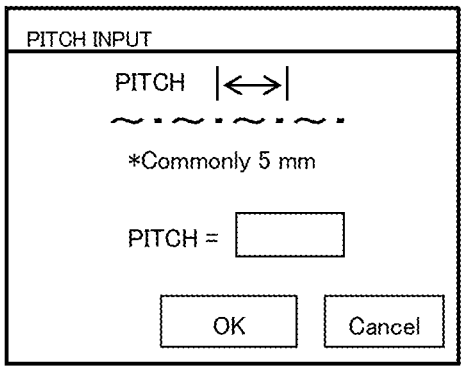
FIG. 6 is a diagram illustrating a display example of a dialog box for inputting a pitch.

FIG. 6 is a diagram illustrating a display example of the dialog box for inputting a pitch.

In S8, the basting pitch editing unit 14 accepts an input of a feed pitch for basting from the user.

Stitches along the four sides are handled as four independent, linear patterns in the basting data, and a sewing pitch may be changed separately for each side.

Figure 7:
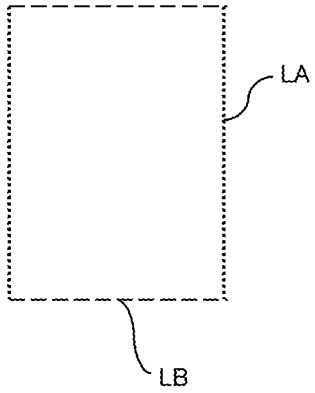
FIG. 7 is a diagram illustrating an example in which a basting pitch is changed.

FIG. 7 is a diagram illustrating an example in which a basting pitch is changed.

The example shown in FIG. 7 shows that a pitch of a vertical basting LA is changed to 3 mm, and a pitch of a horizontal basting LB is unchanged and remains at 5 mm.

In general, a linear pattern with a long feed pitch serves as basting to fix an interliner to a material such as cloth or leather to which embroidery is made, and the stitch is often removed or cut out after embroidery of the pattern is competed. Further, a linear pattern with a short pitch is used as a stitch for a straight line. For example, in the example shown in FIG. 7, while the vertical basting LA is formed using a basting function, the vertical basting LA is used as a stitch without being removed afterwards.

Here, if there is no input for changing the pitch, the basting data generating unit 13 generates the basting data at 5 mm pitch.

In S9, the basting position editing unit 15 changes the positions of the four sides according to a drug operation in the edit screen, and records the positions.

Figure 8:
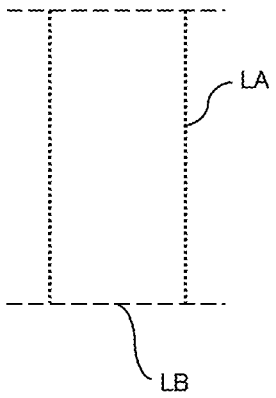
FIG. 8 is a diagram illustrating an example in which a position of a side of the basting area is changed.

FIG. 8 is a diagram illustrating an example in which the position of the side of the basting area is changed.

The example shown in FIG. 8 shows a state in which the drug operation is performed in the state of FIG. 7, and the vertical basting LA is changed. For example, when cloth to which embroidery of the linear pattern of the basting is made is moved to the center as shown in FIG. 8, the basting is intended to be used as a stitch.

Further, the basting position editing unit 15 is able to delete any side of the basting according to the user's operation.

In S10, as the size of the rectangle for basting, the sewing pitch, and the position of the basting are confirmed in the operation in S7, S8, and S9, the basting data generating unit 13 generates the basting data, returns the screen to the edit screen in S2, and waits for a next instruction.

In S11, as the OK button 52*e* is pressed in S6, the control unit 30 terminates the edit screen, and displays the execution screen for embroidery in the display unit 25.

Figure 9:
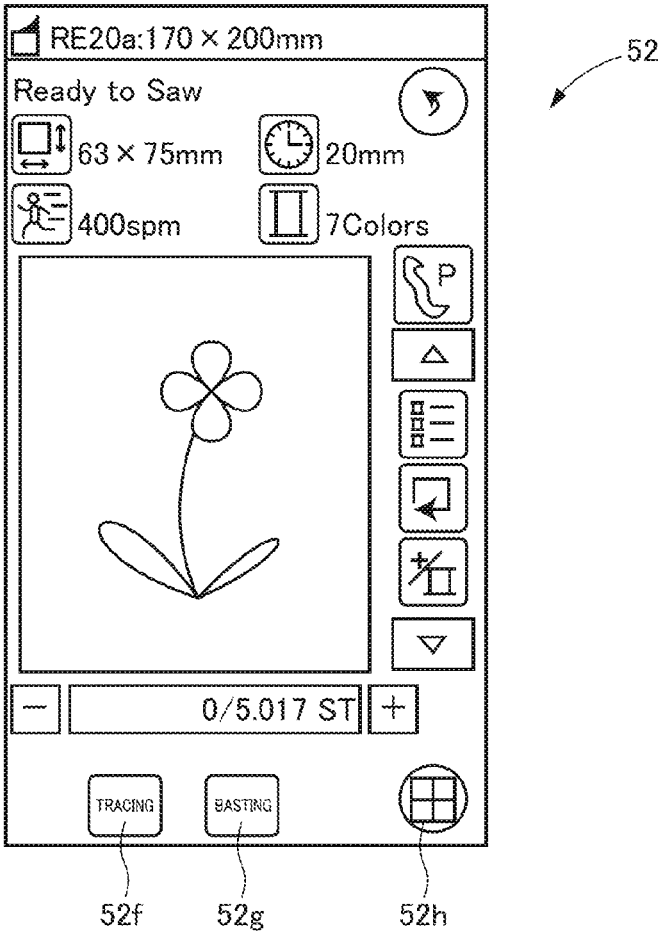
FIG. 9 is a diagram illustrating a display example of an execution screen of embroidery.

FIG. 9 is a diagram illustrating a display example of the execution screen for embroidery.

In S12, the trace start accepting unit 16 determines whether or not a trace button 52*f* is pressed. If the trace button 52*f* is pressed, the operation moves to execution of trace (S15). On the other hand, if the trace button 52*f* is not pressed, the operation moves to S13.

In S13, the basting start accepting unit 18 determines whether or not a basting button 52*g* is pressed. If the basting button 52*g* is pressed, the operation moves to execution of basting (S16). On the other hand, if the basting button 52*g* is not pressed, the operation moves to S14.

In S14, the embroidery start accepting unit 20 determines whether or not an embroidery start button 52*h* is pressed. If the embroidery start button 52*h* is pressed, the operation moves to execution of embroidery (S17). On the other hand, if the embroidery start button 52*h* is not pressed, the operation returns to S11, and the above steps are repeated.

In S15, the trace executing unit 17 performs the trace operation along the rectangular line based on the basting data. This is an operation for moving the embroidery frame 70 along a rectangle line in the basting data without dropping the needle 61 (without sewing) to visually confirm that the material 110 to which basting is desired is positioned immediately under the needle 61. Upon completion of S15, the operation returns to S11.

In S16, the basting executing unit 19 performs basting based on the basting data.

Figure 10:
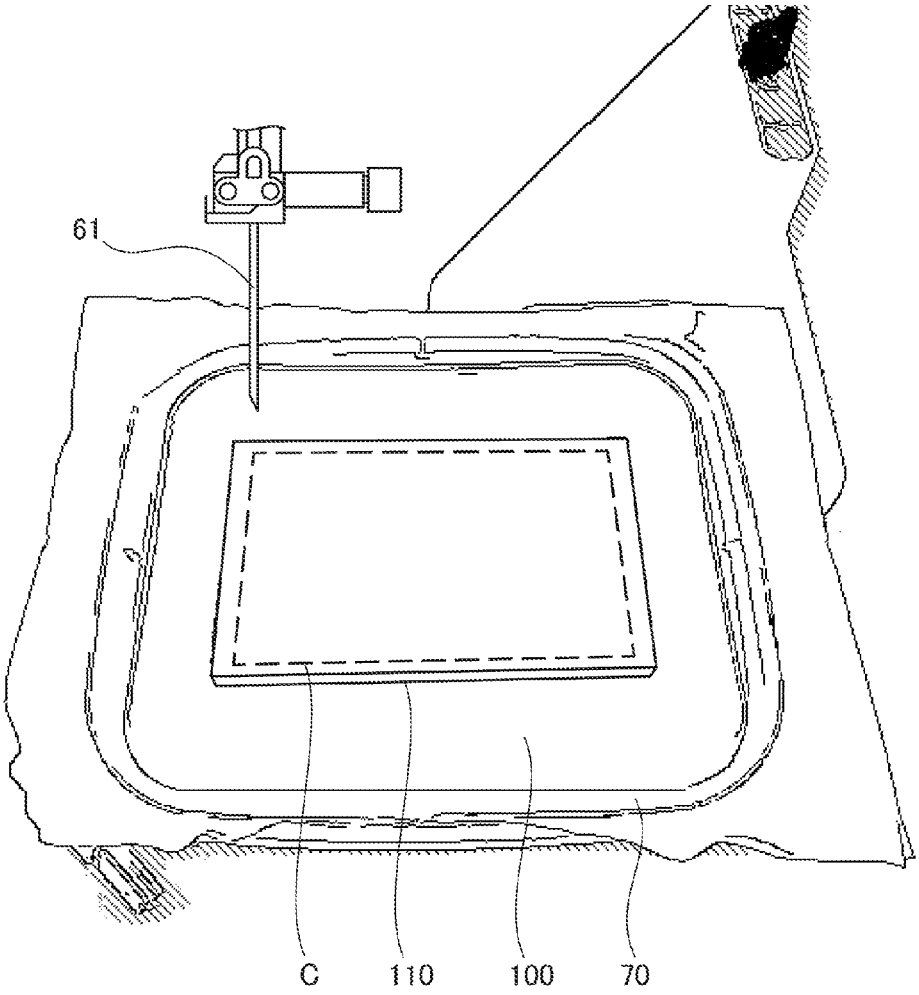
FIG. 10 is a diagram illustrating a state in which basting is performed.

FIG. 10 is a diagram illustrating a state in which basting is performed.

A basting stitch C is formed in the material 110 such as leather disposed over the interliner 100 held by the embroidery frame 70, and the material is fixed.

Upon completion of S16, the operation returns to S11.

In S17, the embroidery executing unit 21 performs the embroidery sewing, and terminates the operation.

As described above, according to this embodiment, by having the basting area accepting unit 12 perform the assisting operation, it is possible to provide an embroidery sewing machine having a function of fixing the interliner 100 and the material 110 by basting, the function allowing simple and appropriate basting according to a size of the material even when the material cannot be fixed only with the embroidery frame 70 or when it is not desirable to fix the material with an embroidery frame, in such a case in which the material is leather or the like.

REFERENCE SIGNS LIST

1: embroidery sewing machine
11: pattern setting unit
12: basting area accepting unit
13: basting data generating unit
14: basting pitch editing unit
15: basting position editing unit
16: trace start accepting unit

17: trace executing unit
18: basting start accepting unit
19: basting executing unit
20: embroidery start accepting unit
21: embroidery executing unit
25: display unit
30: control unit
40: external input/output unit
51: display control unit
52: display unit
52*a*: pattern display unit
52*b*: basting button
52*c*: pitch button
52*d*: line indicating basting area
52*e*: OK button
52*f*: trace button
52*g*: basting button
52*h*: embroidery start button
53: tactile switch
54: touch panel
55: sewing machine motor control unit
56: sewing machine motor
57: motor control unit
58: X motor
59: Y motor
60: sewing mechanism
61: needle
70: embroidery frame
81, 82, 83, 84: jog button
85: point A specifying button
86: point B specifying button
100: interliner
110: material

The invention claimed is:

1. An embroidery sewing machine having a function of fixing an interliner and a material by basting, and capable of performing embroidery sewing based on embroidery sewing data, the embroidery sewing machine comprising:

a basting area accepting unit that performs an assisting operation for a user so as to allow the user to specify an area for basting according to a size of a material, and to accept the specification of the area for basting;

a basting data generating unit that generates basting data according to the area accepted by the basting area accepting unit; and a basting executing unit that performs basting based on the basting data generated by the basting data generating unit, the basting area accepting unit accepts the specification of the basting area while a relative position between an embroidery frame and a needle is actually moved in the assisting operation in response to the user's operation.

2. The embroidery sewing machine according to claim 1, wherein the basting area accepting unit accepts a rectangular area of a size contained within an embroidery frame.

3. The embroidery sewing machine according to claim 1, the embroidery sewing machine comprising:

a basting position editing unit that performs position change and/or deletion to a side corresponding to any of linear stitches separately in the basting data generated by the basting data generating unit.

4. The embroidery sewing machine according to claim 1, the embroidery sewing machine comprising:

a basting pitch editing unit that changes a pitch of a basting stitch of a side corresponding to any of linear stitches separately in the basting data generated by the basting data generating unit.

5. The embroidery sewing machine according to claim 1, the embroidery sewing machine further comprising:

a trace start accepting unit that accepts an instruction to start tracing; and a trace executing unit that performs a trace operation in response to the acceptance of the instruction to start tracing by the trace start accepting unit, the trace operation being for moving an interliner with respect to a needle based on the basting data without sewing.

6. The embroidery sewing machine according to claim 1, the embroidery sewing machine comprising:

a basting start accepting unit that accepts an instruction to start basting, wherein the basting executing unit performs basting based on the basting data, separately from embroidery sewing, in response to the acceptance of the instruction to start basting by the basting start accepting unit.

7. The embroidery sewing machine according to claim 1, the embroidery sewing machine further comprising:

an embroidery start accepting unit that accepts an instruction to start embroidery sewing; and an embroidery executing unit that performs embroidery sewing based on the embroidery sewing data, separately from basting, in response to the acceptance of the instruction to start embroidery by the embroidery start accepting unit.

* * * * *